United States Patent [19]

Montgomery

[11] 4,159,852

[45] Jul. 3, 1979

[54] CONTINUOUS MINING MACHINE WITH IMPROVED CUTTER HEAD SLIDE MEANS

[76] Inventor: Warren G. Montgomery, 1146 Berwood Rd., Morgantown, W. Va. 26505

[21] Appl. No.: 886,478

[22] Filed: Mar. 14, 1978

[51] Int. Cl.[2] ..... E21C 31/06

[52] U.S. Cl. ..... 299/56; 173/147

[58] Field of Search ..... 299/56, 57; 173/147

[56] References Cited

U.S. PATENT DOCUMENTS

| | | | |
|---|---|---|---|
| 2,819,042 | 1/1958 | Feucht | 173/147 X |
| 2,868,508 | 1/1959 | Cowan | 173/147 X |
| 3,433,533 | 3/1969 | Webster | 299/56 |
| 4,046,424 | 9/1977 | Montgomery | 299/56 |

*Primary Examiner*—Ernest R. Purser

*Attorney, Agent, or Firm*—Pennie & Edmonds

[57] ABSTRACT

A continuous mining machine has a rotatable cutter head which is slidably mounted on a feed bar which in turn is slidably mounted on a support bar carried by a movable carrier. A cable extends over a sheave which is mounted on one end of the feed bar where one end of the cable is connected to the cutter head and the other end fixed with respect to the support bar. Means are provided for sliding the feed bar longitudinally with respect to the support bar whereby the cutter head will slide along the feed bar at twice the velocity that the feed bar slides with respect to the support bar.

4 Claims, 4 Drawing Figures

3
11
7
16
15
8
17
12
12'
13
22
4
17'
18
19
10
21
20
2

CONTINUOUS MINING MACHINE WITH IMPROVED CUTTER HEAD SLIDE MEANS

FIELD OF THE INVENTION

The invention relates to a continuous mining machine comprising a tracked carrier mounting a vertical movable support bar. A feed bar is slidably mounted on the support bar to move along the longitudinal axis thereof and a rotatable cutter head is slidably mounted on the feed bar. Drive means extend between the support bar and the feed bar and serve to move the feed bar relative to the support bar. A cable extends over a sheave carried on one end of the feed bar and is connected at one end to the support bar and at its other end to the cutter head. Movement of the feed bar by the drive means will then cause the cutter head to move with respect to the feed bar at twice the velocity that the feed bar moves with respect to the support bar that is to say, the cutter head will move twice as far as the feed bar in the same period of time.

DESCRIPTION OF THE PRIOR ART

Continuous mining machines have been proposed in the past which slidably mount a cutter head onto a feed bar which in turn is slidably mounted on a support bar in order that the cutter head may be traversed across a mine face to make a kerf. For example see the continuous mining machine disclosed in U.S. Pat. No. 3,433,533. Such machines in the past have required a drive means for moving the cutter head with respect to the feed bar and a separate drive means to move the feed bar with respect to the support bar. Such a multiplicity of drive means increases the initial cost of the mining machine while at the same time results in structure having increased maintainance expenses.

It is therefore an object of my invention to provide for a continuous mining machine which will have a minimum of driving motors for moving the cutter head with respect to the machine in order that the cutter head may be traversed across a mine face to make a kerf. It is a further object of my invention to provide for a continuous mining machine in which all movements of the cutter head with respect to the mine face will be working movements, that is will be movements during which a cutting operation is performed. This increases the speed of cutting since no time will be lost in returning the cutter head to a starting position from which a new cut is to be initiated.

SUMMARY OF THE INVENTION

Broadly my invention comprises having a support bar mounted on a carrier and on which a feed bar is slidably moved by a single drive means. A cutter head is slidably mounted on the feed bar so as to move along the longitudinal axis thereof. A sheave is rotatably mounted on the end of the feed bar and has a cable extending thereover which is connected at one end to the cutter head and is fixed at its other end with respect to the support bar. In such a construction the cutter head will move with respect to the feed bar at twice the velocity that the feed bar moves with respect to the support bar and wherein the single drive means affords a means to move the feed bar with respect to the support bar and at the same time to move the cutter head with respect to the feed bar.

Preferably the drive means comprise a hydraulically driven hoist drum which is mounted on one end of the feed bar over which a cable extends which is connected at one end to the support bar. In addition the cutter head is driven by a hydraulic motor means which is connected by hoses extending over hose sheaves carried at one end of the feed bar and which connect to a source of hydraulic pressure mounted on the carrier.

DESCRIPTION OF THE PREFERRED EMBODIMENT

Figure 1:
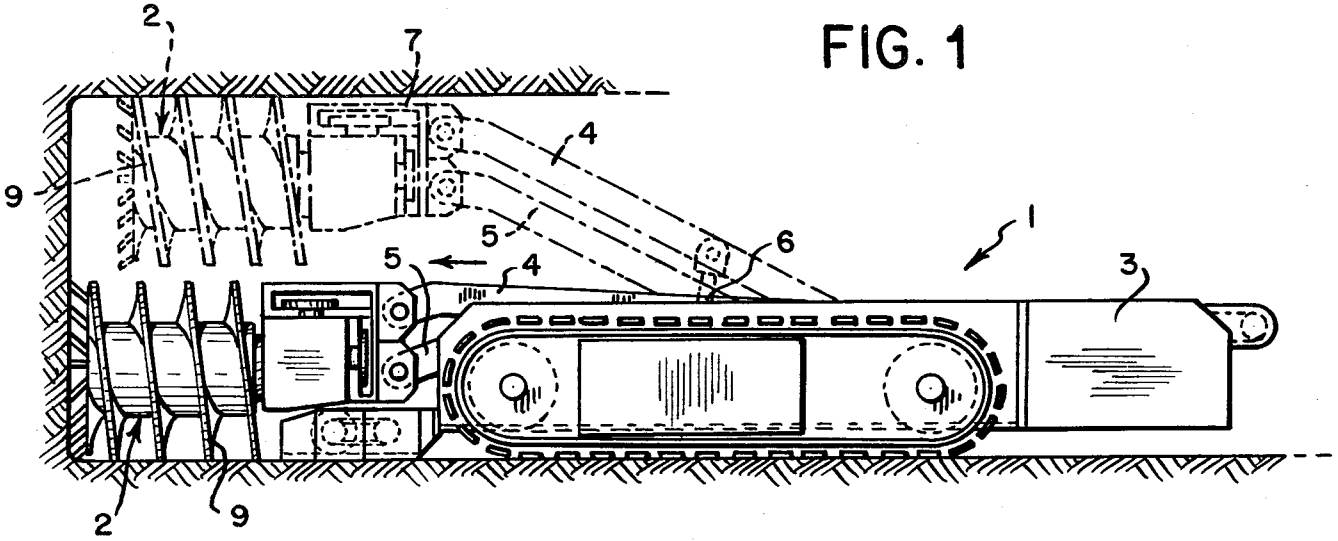
FIG. 1 is a side view of a continuous mining machine constructed according to the invention.
Figure 3:
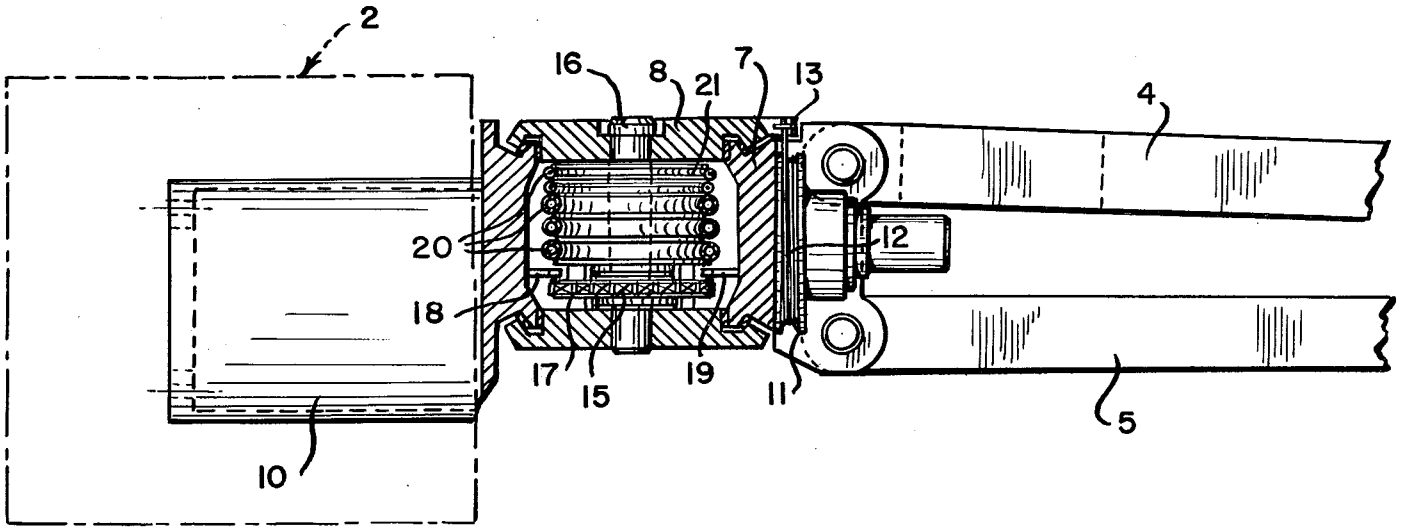
FIG. 3 is a sectional view of FIG. 2 taken along lines 3—3.
Figures 2, 4:
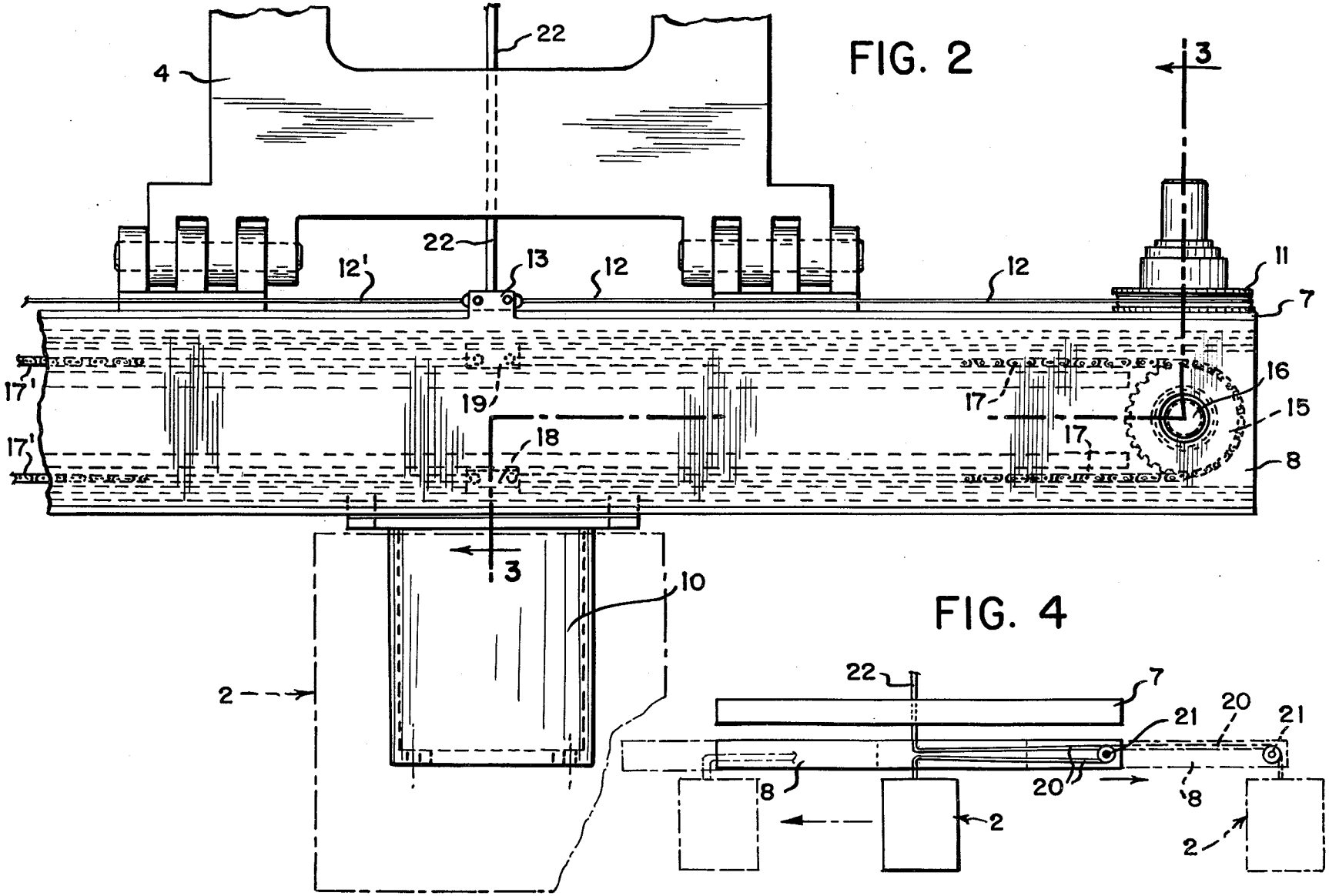
FIG. 2 is an enlarged plan view of a portion of the continuous mining machine of FIG. 1.
FIG. 4 is a schematic view illustrating diagrammatically a hose connection between the cutter head and the source of hydraulic pressure on the carrier.

Referring to FIG. 1 there is illustrated a continuous mining machine 1 constructed according to the invention having a rotatable cutter head 2 adapted to be carried by a crawler type carrier 3. The carrier 3 has upper head and lower head elevator bars 4 and 5 which are raised and lowered by means of a hydraulic piston 6. The bars 4 and 5 are pivoted at their ends to a support bar 7. Support bar 7, as shown in FIG. 2, in turn slidably mounts a feed bar 8 which in turn slidably mounts the cutter head 2. The support bar 7 and feed bar 8 are substantially coextensive in length as shown in FIGS. 2 and 4. The cutting auger portion 9 of the cutter head 2 is driven by means of a hydraulic motor 10 shown in outline form in FIGS. 2 and 3.

A hydraulically driven hoist drum 11 is mounted on one end of the support bar 7. A cable 12 is wound over the periphery of the drum and is connected to a clevis 13 which in turn forms a part of the feed bar 8. Rotation of the hoist drum 11 pulls the cable 12 and feed bar 8 to move the same with respect to the support bar 7. A second hydraulically driven hoist drum, not shown, is mounted on the opposite end of the support bar 7 and is connected to the clevis 13 by way of cable 12' in order that the feed bar may be moved to the left as shown in FIG. 2. Alternatively the hydraulically driven hoist 11 could be made double acting so as to rotate in both directions. In this construction only one such hydraulically driven hoist drum would be required to move the feed bar 8 in both directions with the other drum being replaced by an idler sheave over which the cable 12 would extend.

A sprocket 15 is rotatably mounted on the end of the feed bar 8 by a pin 16 and meshes with cable or chain 17. One end of the cable or chain 17 is connected to a clevis 18 fixed to the cutter head 2 with the other end being connected to a clevis 19 connected to the support bar 7. Thus it is seen that when the feed bar 8 is moved longitudinally with respect to the support bar 7 by the hydraulically driven hoist drum 11, the cutter head 2 will be caused to move longitudinally with respect to the feed bar 8 and at twice the velocity that the feed bar 8 moves with respect to the support bar 7. Further it is seen that movement of both the feed bar 8 and the cutter head 2 is accomplished by the hoist drums 11 thus eliminating any need for a separate hydraulic motor to move the cutter head 2.

The hydraulic motor 10 is connected by means of hoses 20 which extend over hose sheaves 21 mounted on pin 16 to a source of hydraulic pressure 22 as shown schematically in FIG. 4. In this manner the hoses 20 may be maintained taut notwithstanding the position of the hydraulic motor 10 longitudinally on feed bar 8 which in turn reduces wear and abrasion of the hoses. The source of pressure 22 in turn connects with a hydraulic pump mounted on the carrier 3.

In operation the elevator bars 4 and 5 are raised lifting the cutter head 2 to the upper dotted position as shown in FIG. 1. The crawler is then advanced such that the cutter head sumps into the mine face while the cutter head is rotating. When the cutter head has cut into the face a desired amount, the cutter head and feed bar are moved longitudinally by the hoist drum in order that the cutter head will traverse the mine face. When the cutter head reaches the end of its travel along the feed bar to a rib position with respect to the mine face, the bars 4 and 5 are then lowered to the position shown in full line in FIG. 1. The cutter head is then moved such that it cuts back to the opposite end of the feed bar to the opposite rib after which the bars 4 and 5 are again raised to the dotted position shown in FIG. 1 and the cutter head returned laterally to its starting position. The operation is then repeated by moving the carrier forward on its crawlers and sumping the cutter head into the mine face after which the cutter head movement cycle is repeated. The cutter head thus cuts on all movements of the cutter head, that is to say, there is no waste movement of the cutter head in returning it to a new cutting position during which time it will not be cutting.

A continuous mining machine constructed according to my invention thus provides for a minimum of hydraulic motors for moving the cutter head with respect to a carrier while at the same time providing for cutting action in all movements of the cutter head.

I claim:

1. A continuous mining machine comprising a carrier, a support bar mounted on said carrier, a feed bar substantially coextensive in length with and slidably mounted on said support bar to move along the longitudinal axis thereof, a cutter head slidably mounted on said feed bar to move along the longitudinal axis thereof, double-acting drive means for sliding said feed bar in alternate directions on said support bar, a sheave rotatably mounted on said feed bar and a cable extending over said sheave having one end fixed to said cutter head and the other end fixed to said support bar whereby when said drive means slides said feed bar with respect to said support bar, said cutter head will slide with respect to said feed bar.

2. A continuous mining machine according to claim 1 having in addition hydraulic motor means connected to said cutter head, a source of hydraulic pressure on said carrier, a hose sheave mounted on one end of said feed bar and a hose extending over said hose sheave having one end connected to said source of hydraulic pressure and the other end connected to said hydraulic motor means whereby said hose will remain taut notwithstanding the position of the cutter head on said feed bar.

3. A continuous mining machine comprising a carrier, a support bar mounted on said carrier, a feed bar slidably mounted on said support bar to move the longitudinal axis thereof, a cutter head slidably mounted on said feed bar to move along the longitudinal axis thereof, a hydraulically driven hoist drum mounted on said support bar for sliding said feed bar on said support bar, cable means connecting said drum with said feed bar, a sheave rotatably mounted on said feed bar and a cable extending over said sheave having one end fixed to said cutter head and the other end fixed to said support bar whereby when said hydraulically driven hoist drum slides said feed bar with respect to said support bar, said cutter head will slide with respect to said feed bar.

4. A continuous mining machine according to claim 3 having a hoist drum mounted on each end of said feed bar and where each said hoist drum may pull said feed bar by said cable means to move said feed bar along said support bar.

* * * * *